United States Patent [19]

Shults et al.

[11] 3,956,789

[45] May 18, 1976

[54] CLEANING TOOL FOR CLEANING CLOSELY SPACED ELECTRICAL CONTACT SURFACES AND THE LIKE

[76] Inventors: Leon Shults, 425 Richard Drive; Carlton C. Zinn, 201 Cliff St., both of McFarland, Calif. 93250

[22] Filed: June 3, 1974

[21] Appl. No.: 475,496

[52] U.S. Cl. ..... 15/88; 15/21 R; 15/97 R; 51/59 R

[51] Int. Cl.[2] ..... A46B 13/02

[58] Field of Search ..... 15/21 R, 40, 56, 59, 15/60, 61, 63, 70, 71, 77, 88, 93, 97 R, 102; 51/59 R

[56] References Cited

UNITED STATES PATENTS

| | | | |
|---|---|---|---|
| 3,434,243 | 3/1969 | Day et al. | 51/59 R |
| 3,803,659 | 4/1974 | Sawatzky | 15/3 |

*Primary Examiner*—Edward L. Roberts
*Attorney, Agent, or Firm*—Lackenbach, Lilling & Siegel

[57] ABSTRACT

This invention provides apparatus for cleaning closely spaced electrical contact surfaces, such as, especially, telephone bank pins, which comprise longitudinally extending rods or wires which are closely spaced and which have exposed electrically conducting surfaces. The apparatus comprises a support means to which is attached a reciprocatably movable multi-digit cleaning member and drive means therefor. The fingers of the multi-digited member have an abrasive surface, such as a napped surface, and preferably also have means for wetting the napped surface with a cleaning liquid. The digits, or fingers, are so spaced on the member as to cooperatively interdigitate with the longitudinal electrical conducting means to be cleaned so as to abrade its surface, and thus clean, the longitudinal conducting element.

8 Claims, 5 Drawing Figures

CLEANING TOOL FOR CLEANING CLOSELY SPACED ELECTRICAL CONTACT SURFACES AND THE LIKE

A significant problem in maintaining the large electrical or electronic equipment such as is used, for example, in telephone transmission stations, is maintaining clean and fully electrically conducting the surfaces of exposed electrical conducting surfaces. Such surfaces are often provided along the perimeters or circumferences of closely spaced elongated bars or rods or wires having exposed metal surfaces, such as copper or aluminum. For example, the Stromberg-Carlson telephone switch bank comprises a series of stacked switch cells, each cell including an *x,y*-switch and a plurality of closely spaced telephone bank pins, i.e. columns of longitudinally aligned rods or wires formed of an electrically conductive material, generally copper or aluminum.

A substantial labor cost is expended in maintaining these telephone bank pins clean and free of corrosion, so as not to interfere with the electrical contact between the switch and the pin. Any incomplete contact drastically interferes with the operation of the telephone switch bank. The bank pins are now cleaned manually using a fork-like, multi-prong cleaning tool. Around the tines of the fork-like cleaning tool is wrapped a cloth which is wetted with a cleaning liquid, generally by being dipped into a reservior of such liquid. As the switch cells are each relatively short, or narrow, along the dimension parallel to the center line of the column of switches, it is generally necessary to remove the *x,y*-switches from several adjacent cells to provide the operator with enough space to manipulate the cleaning tool; this results in a shut-down of several cells for an extended period, instead of only the shutdown of the one cell being cleaned at any given time.

The present invention provides a method of cleaning the surfaces of, for example, bank pins of one entire *x,y*-switch cell, one cell at a time, if desired, without interfering with the immediately adjacent cells. The device of the present invention cleans the surfaces of longitudinal, closely spaced, conducting elements, to remove dust, grease and corrosion. The cleaning is achieved by abrasion caused by a reciprocating element interspersed intermediate the adjacent bank pins. Preferably, the abrading action is combined with the solvent action of the cleaning liquid.

The cleaning apparatus of the present invention comprises, in combination:

a support member adapted to be mounted on a supporting frame;

holding means attached to the support member and designed and adapted to maintain the support member stationary and in a suitable juxtaposition to the supporting frame and to the apparatus to be cleaned;

multi-digited cleaning means slidably attached to the support member, the cleaning means being slidable in a plane substantially parallel to the support frame and to the plane of the axes of the fingers or digits, each of the digits having an abrasive surface; and reciprocating driving means mounted on the support member and operatively connected to the cleaning means so as to drive the cleaning means to reciprocatingly slide relative to the support means;

whereby, the digits of the cleaning means can move reciprocatingly beyond the edges of the support member and rub against a surface to be cleaned.

Preferably, there is also provided a plurality of guide elements, rigidly attached to the support member, generally adjacent the edge of the support member beyond which the digits reciprocatingly extend. The guide elements are juxtaposed intermediate the adjacent digits so as to maintain the digits at a desirable spacing. The digits are preferably spaced and are of a suitable thickness so as to pass between the adjacent longitudinally extending conductor pins to be cleaned.

There is also further preferably mounted onto the support member motor means, preferably an electric or fluid pressure motor, for energizing the driving means to reciprocatingly drive the multi-digited cleaning means. Manual drive means, for example a crank or rotor, can also be provided as an alternative or in addition to the motor means.

Preferably, the digits, or fingers, have a napped, lint-free surface, wherein the nap is most preferably wetted with a cleaning fluid to aid in the removal and/or dissolution of the deposits on the surface to be cleaned, such as grease or corrosion. Useful nap surfaces for the cleaning digits include, for example, mohair, crushed velvet (formed, for example of silk, silk and cotton, rayon, or nylon, e.g. Nylovel, manufactured by ABC Backing Company, Kansas City, Mo.).

A preferred embodiment of the apparatus in accordance with the present invention is shown in the accompanying drawings and described in detail below. The exemplified embodiment is merely one aspect of the claimed invention and is not limiting of the entire scope thereof. In the drawings:

Figure 1:
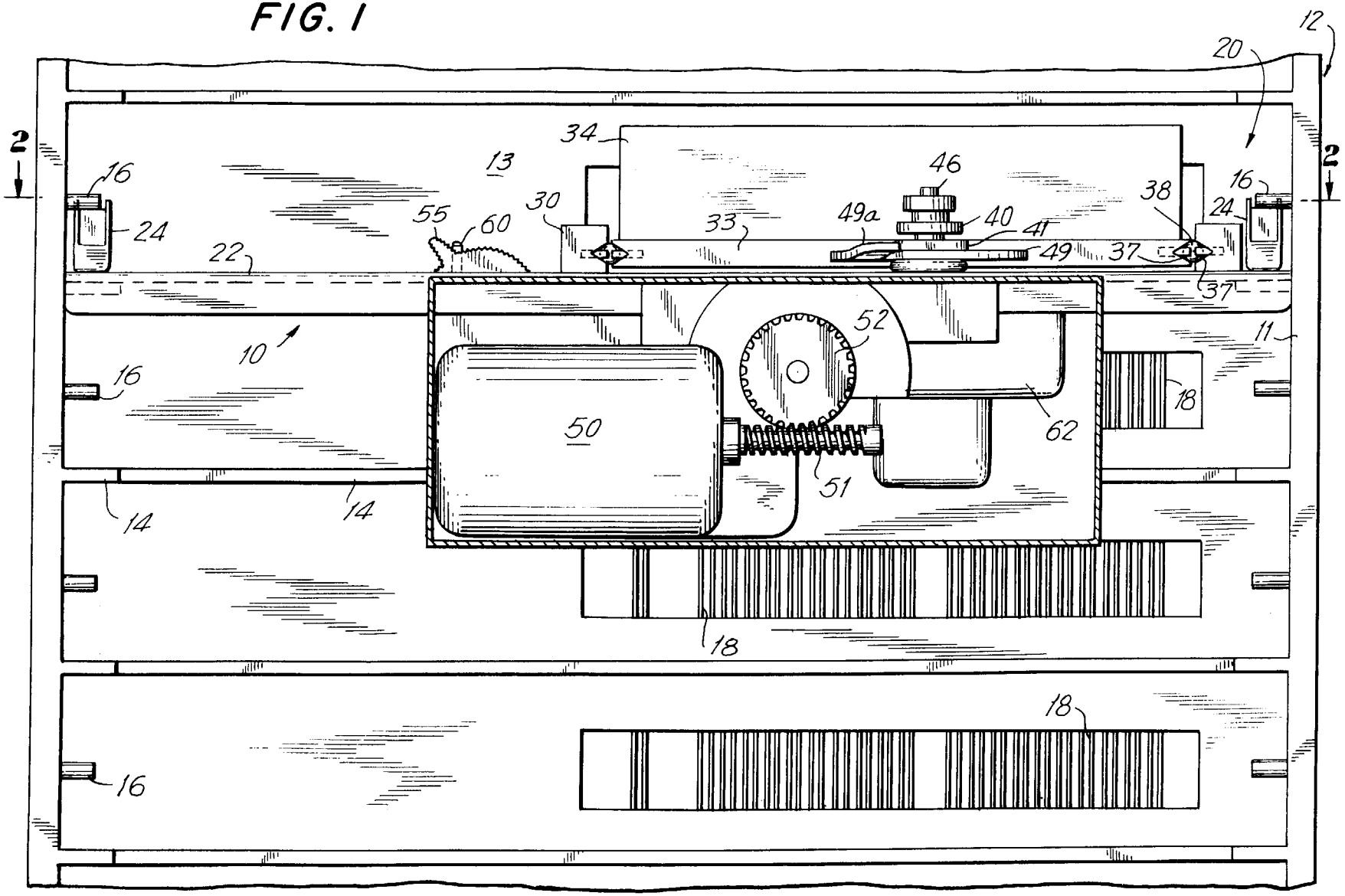
FIG. 1 is a partially sectioned front elevation view showing the cleaning apparatus of the present invention in operating position for cleaning one cell of a Stromberg-Carlson telephone switch bank.

Referring now to the drawings, a switch bank pin cleaning apparatus, generally designated by the numeral 10, is shown in operating position within a Stromberg-Carlson *x,y*-switch bank console, generally indicated by the numeral 12. The console comprises a plurality of stacked switch cells 20 (here shown with the switches removed so as to expose the bank pins in the cells 20 immediately below that being cleaned by the apparatus of the invention). The console having side and rear walls 11,13, the walls providing a shelf frame 14 for each cell and holding pins 16 intended for support of the *x,y*-switches and also utilized herein for support of the cleaning apparatus 10. Through the rear wall 13 of the console, there are formed generally rectangular openings through which is exposed the switch pins 18 for each cell. The apparatus 10 shown in the drawing of FIG. 1 is in position to clean the bank pins (which are not visible) in each cell which has hereinbefore generally indicated by the numeral 20.

The cleaning apparatus 10 comprises a support member, in this embodiment shown as the generally flat plate 22. Alternatively, of course, the support member can be merely a frame having a plurality of cross pieces to which the various components can be attached. In this case, the support plate 22 extends across the cell 20 and rests upon the shelf frame 14. Connected to support plate 22 are spring bracket 24 connected at one end to the plate 22 and at the second end to the holding pins 16, which are rigidly attached to the side walls of console 12. The brackets 24 and pins 16 coact to prevent movement of the support frame 22 out of the console during operation of the cleaning apparatus, and act in the same manner as similar elements in the *x,y*-switches.

Rigidly attached to the inner end of plate 22, i.e. that adjacent the rear wall 13 of the console 12, is a guide member 28 comprising longitudinally extending elements 29 extending perpendicularly upwardly from the top surface of plate 22. Also rigidly attached to the top surface of plate 22, extending forwardly in a direction perpendicular to the guide elements 29, are track means 30. Slidably held between track means 30 is an interdigitated cleaning member, generally indicated by the numeral 32. The cleaning member 32 comprises a base member 33 to which is removably attached a multi-digited comb 34, including a plurality of parallel fingers 35. Ball-bearing races 37 are provided along both sides of the base member 33 and of the tracks 30. Ball bearings 38 are provided in the races 37 of the tracks 30 and base member 33, so that base member 33 moves along with the ball-bearings 38. Connecting rod 40 is pivotally pinned at one end, via pin 45, to the base 33 and at the other end, via pin 46, to one end of the crank rod 41. The other end of the crank rod 41 is pivotally pinned, via axial pin 48, to the support plate 22. Also pivotally pinned to plate 22, via axial pin 48, is the drive disk 49, having a raised drive surface **49*a*. The drive linkage defined by disk 49, crank 41 and connecting pin 40, is a conventional sliding-block linkage; however, any other conventional type of drive means can be utilized for driving the multi-digited member 34** in a reciprocating motion.

Drive disk 49, in this embodiment, is driven by the electric motor 50, via worm gear 51 and spur gear 52. The electric motor 50 is driven by a power source, not shown, connected to pins 60, and can be activated by the throw switch 55.

Figure 2:
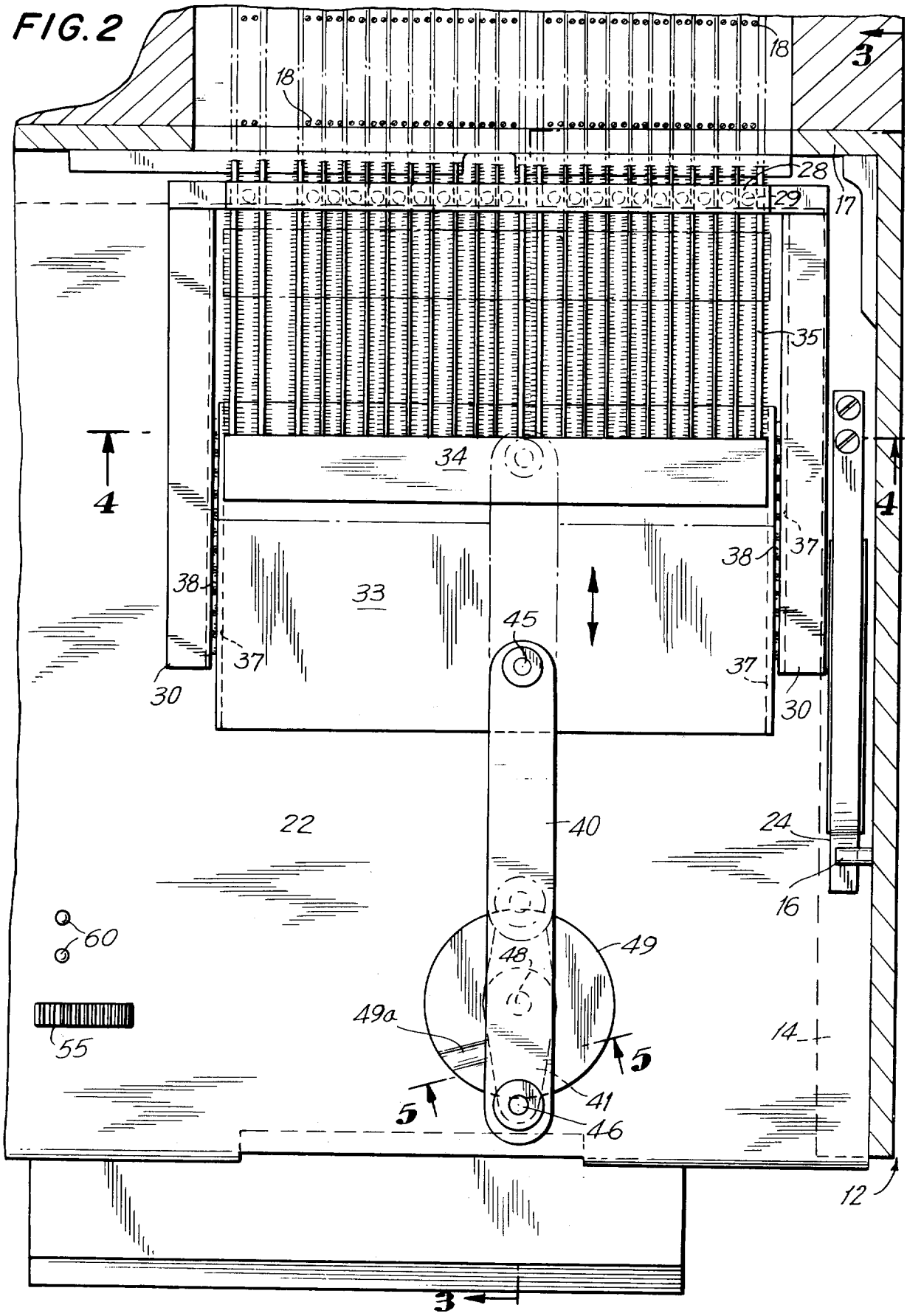
FIG. 2 is a sectional view taken along a line indicated by lines 2—2 of FIG. 1, in the direction of the arrows.
Figure 3:
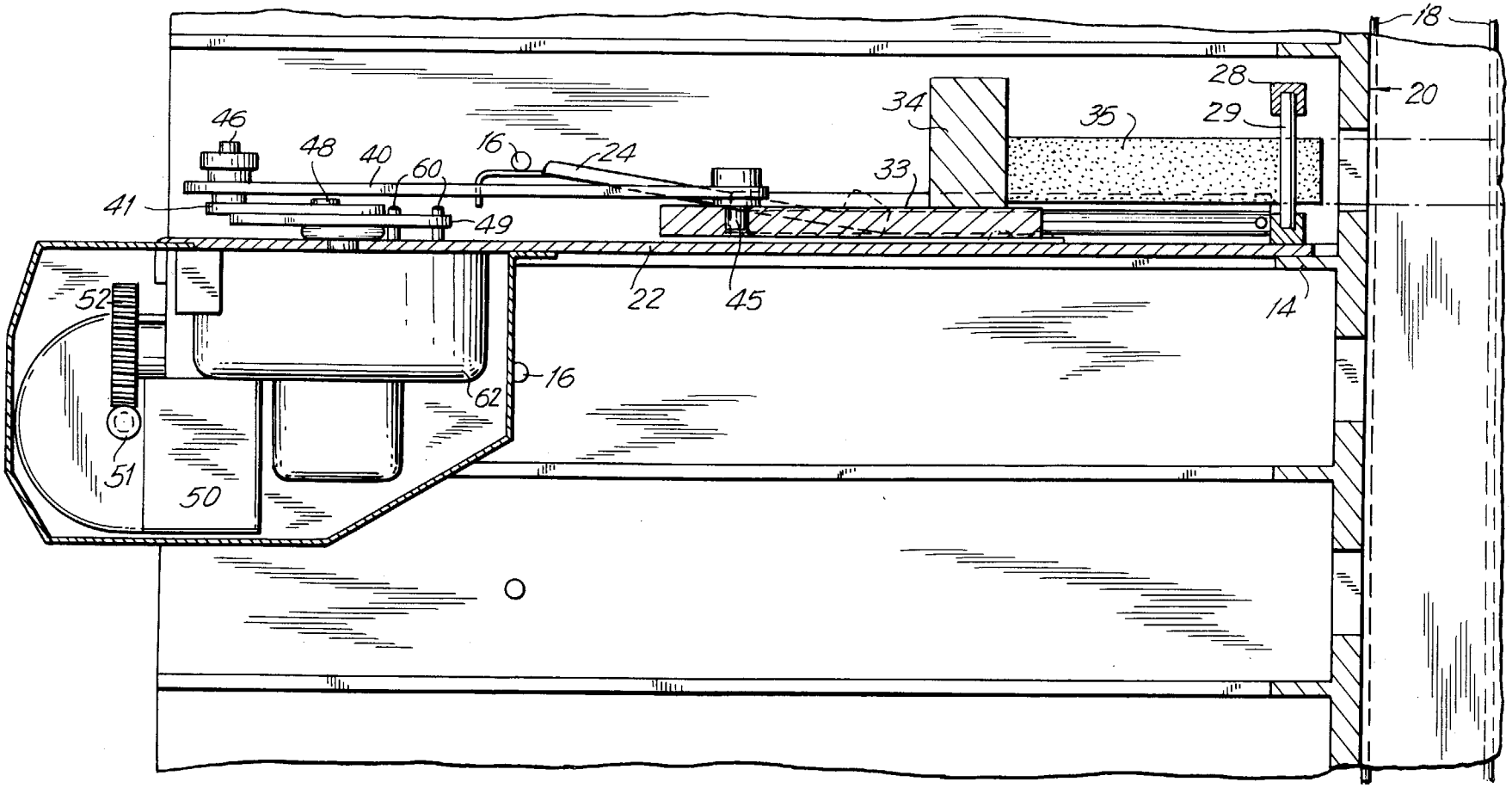
FIG. 3 is a sectional view taken along lines 3—3 of FIG. 2 and in the direction of the arrows.
Figure 4:
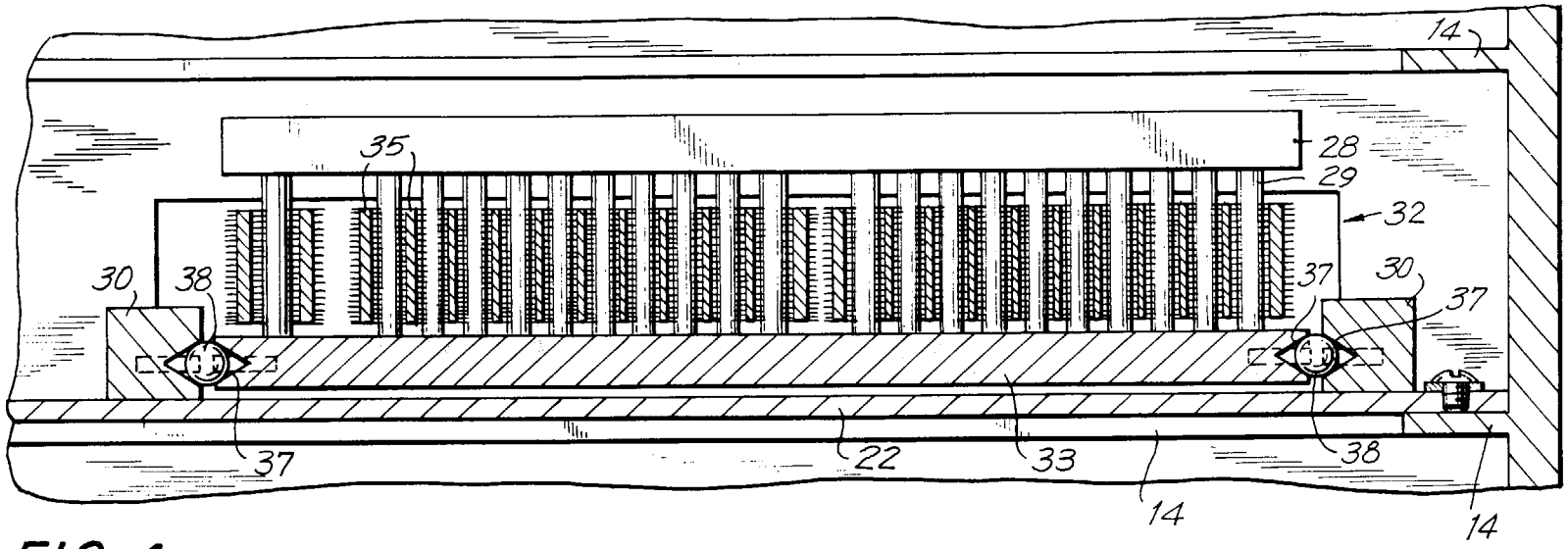
FIG. 4 is a sectional view taken along lines 4—4 of FIG. 2 and in the direction of the arrows.
Figure 5:
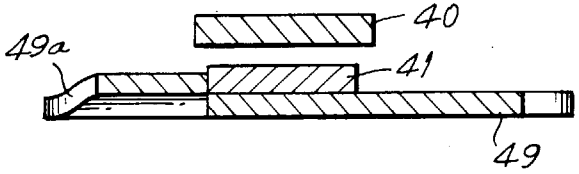
FIG. 5 is a slightly enlarged view taken in cross-section along lines 5—5 in FIG. 2 and in the direction of the arrows.

The process carried out for the operation of the apparatus in accordance with the present invention is as follows:

An *x,y*-switch is removed from one cell of a Stromberg-Carlson telephone console 12; the cleaning apparatus 10 of the present invention is inserted in its place such that the sides and forward edges of the plate 22 rest upon the shelf frame 14 on the walls of the console 12 and the spring bracket 24 holds firmly against holding pins 16 on the walls of the console, thus securely and firmly holding the cleaning apparatus in place against any movement until the spring brackets 24 are depressed to release their hold on pins 16. The electric motor 50 is connected to its power source and activated by throw switch 55, which in this case is a multi-speed switch. As shown in the drawings, particularly in FIG. 2, the fingers 32 of the multi-digited cleaning member 34 are spaced so as to pass between the telephone bank pins 18, preferably cleaning the entire column of pins. As shown, there are several rows of pins 18 located forwardly of the inner wall 17 of the console 12 and accessible through the opening in the inner wall 17, as best shown in FIG. 2.

Upon activation of the motor 50, the driving disc 49 is activated and surface **49*a* acts against the driven crank rod 41 causing it to rotate about pin 48. The generally circular movement of the end of the crank rod 41, i.e. at pin 46, causes a corresponding movement in the end of the connecting rod 40, which in turn causes reciprocating movement of the other end 45 of rod 40 and thus reciprocating movement of the plate 33 and the multi-digited member 34, rigidly attached thereto. In a preferred embodiment, the multi-digited member 34 is removably, but rigidly, attached to the plate 33 so that as the fingers 35 become worn by rubbing against the bank pins 18, they can be replaced. The fingers 35, as shown, have a napped surface, in this case, formed by the preferred Nylovel having a nap length equal to at least about half the diameter of the telephone bank pins to be cleaned. By utilizing such a material, the entire surface of the pins can be reached by the cleaning material. The cleaning fingers 35 are shown in solid lines in their retracted position and by phantom lines in their extended position, passing between the rows of bank pins 18, in FIG. 2.**

In this most preferred embodiment, a slip clutch 62, of a conventional type, is provided in the transmission. This provides a safety factor to eliminate excessive pressure being applied by the fingers against the bank pins 18, in the event of the fingers being bent or misaligned, thus preventing damage to the equipment.

There can be also provided a reservior of cleaning fluid for applying fluid to the napped surfaces of the cleaning fingers 35 to aid in the cleaning operation.

As shown, the guide element 28, 29 and the multi-digited cleaning member 34 are removable to be replaced when worn out or to be replaced for use for a series of conductor elements having different spacings or differing numbers of longitudinal conducting elements. The particular spacing shown in the accompanying diagrams are those commonly found in the Stromberg-Carlson units. However, as indicated, any spacing of such conductor elements can be utilized. Similarly, the conductor elements in the Stromberg-Carlson units are thick wire, or thin rods; however, alternatively, in addition to units having generally circular cross-section pins, bars having rectangular, or other polygonal cross-section, can also be cleaned in accordance with the present invention.

The Stromberg-Carlson switch bank pin cleaning apparatus exemplified in the above description is intended to clean 10 or 11 rows of the approximately 1/16-inch copper or brass pins, formed in about 22 columns, i.e. requiring 23 cleaning fingers. The 11 rows of pins extend forwardly beyond the back wall 13 of the console chamber for less than about 2 inches. Accordingly, the cleaning fingers 35 must be sufficiently long to extend beyond that wall at least about 2 inches. It has generally been found that a finger length of from about 2 to about 4 inches is sufficient to meet this requirement. Generally, the speed of operation is determined by the operator to be that which is most suitable for the condition of the bank pins to be cleaned.

The fingers 35 are shown to be formed as substantially parallel bars having rectangular cross-sections and are approximately 3 inches long and 1 inch high. Alternatively, the fingers can have circular cross-sections, oblong cross-sections or can be a plurality of small rectangular or circular cross-sections having a total height equal to that of the bank pins to be cleaned.

The thickness of each finger is preferably set such that it forms a relatively snug fit against the adjacent bank pins between which it passes during the cleaning operation. This ensures that an adequate scrubbing or abrading action is applied by the nap of the fingers against the entire surface of the bank pin.

The fingers can be cleaned, after use, by being immersed within a reservoir of cleaning fluid while being reciprocated adjacent a series of cleaning wires having a spacing substantially the same as that of the bank pins; this also serves to saturate the cleaning fingers with the cleaning solution which is sufficient to permit cleaning of several cells of bank pins before being rewetted with solution.

The embodiments described above and shown in the accompanying drawings are intended to be merely exemplary of the present invention. Many alternative embodiments having elements which are the equivalent of and carry out the same function as the elements set forth in the above embodiments can be obvious to those skilled in the art. Such obvious alternatives and equivalents are intended to be within the scope of the present invention as defined by the following claims.

The scope of the present invention which is claimed is:

1. A cleaning apparatus comprising, in combination:

a support member adapted to be mounted onto a supporting frame;

multi-digited cleaning means slidably attached to the support member, the axis of the digits forming a plane, the cleaning means being slidable in a plane substantially parallel to the support member and to the plane formed by the axes of the digits, each of the digits having a surface provided with nap means of a sufficient length so as to be adapted to wipe a plurality of surfaces to be cleaned;

reciprocating driving means mounted on the support member and operatively connected to the cleaning means so as to drive the multi-digited cleaning means to reciprocatingly slide relative to the support member;

so that the digits of the cleaning means can reciprocatingly move beyond the edge of the support member and rub against said plurality of surfaces to be cleaned, whereby said nap means may be used and is adapted to retain a cleaning fluid for aiding in the cleaning operation.

2. A cleaning apparatus comprising, in combination:

a support member adapted to be mounted onto a supporting frame;

holding means attached to the support member and adapted to maintain the support member stationary and in juxtaposition to the supporting frame;

multi-digited cleaning means slidably attached to the support member, the axes of the digits forming a plane, the cleaning means being slidable in a plane substantially parallel to the support member and to the plane formed by the axes of the digits, each of the digits having an abrasive surface; and reciprocating driving means mounted on the support member and operatively connected to the cleaning means so as to drive the multi-digited cleaning means to reciprocatingly slide relative to the support member;

so that the digits of the cleaning means can reciprocatingly move beyond the edge of the support member and rub against a plurality of surfaces to be cleaned.

3. A cleaning apparatus comprising, in combination:

a support member adapted to be mounted onto a supporting frame;

multi-digited cleaning means slidably attached to the support member, the axes of the digits forming a plane, the cleaning means being slidable in a plane substantially parallel to the support member and to the plane formed by the axes of the digits, each of the digits having an abrasive surface;

reciprocating driving means mounted on the support member and operatively connected to the cleaning means so as to drive the multi-digited cleaning means to reciprocatingly slide relative to the support member; and a plurality of guide elements, rigidly attached to the support member, adjacent the edge of the support member beyond which the digits reciprocatingly extend, the guide elements being juxtaposed intermediate the adjacent digits, so as to maintain a spacing between the digits;

so that the digits of the cleaning means can reciprocatingly move beyond the edge of the support member and rub against a plurality of surfaces to be cleaned.

4. The cleaning apparatus of claim 1, comprising, in addition, driving motor means having a rotational movement, mounted onto the support member and operatively connected to the driving means for activating the driving means to reciprocatingly drive the multi-digited cleaning means.

5. The cleaning apparatus of claim 4, wherein the driving means comprise a linkage for converting the rotational movement of the motor means into longitudinal reciprocating movement to drive the multi-digited cleaning means.

6. The cleaning apparatus of claim 5, wherein the motor is an electric motor.

7. A cleaning apparatus comprising, in combination:

a support member adapted to be mounted onto a supporting frame;

multi-digited cleaning means slidably attached to the support member, the axes of the digits forming a plane, the cleaning means being slidable in a plane substantially parallel to the support member and to the plane formed by the axes of the digits, each of the digits having an abrasive surface in the form of a napped, lint-free surface; and reciprocating driving means mounted on the support member and operatively connected to the cleaning means so as to drive the multi-digited cleaning means to reciprocatingly slide relative to the support member;

so that the digits of the cleaning means can reciprocatingly move beyond the edge of the support member and rub against a plurality of surfaces to be cleaned.

8. The cleaning apparatus of claim 1, wherein the support member is a substantially flat plate.

* * * * *